US005635970A

United States Patent [19]

Shirota et al.

[11] Patent Number: 5,635,970

[45] Date of Patent: Jun. 3, 1997

[54] PRINTING PROCESS, AND PRINT AND PROCESSED ARTICLE OBTAINED THEREBY

[75] Inventors: Koromo Shirota, Inagi; Masahiro Haruta, Suginami; Shoji Koike; Aya Takaide, both of Yokohama; Tomoya Yamamoto; Mariko Suzuki, both of Kawasaki, all of Japan

[73] Assignee: Canon Kabushiki Kaisha, Tokyo, Japan

[21] Appl. No.: 268,559

[22] Filed: Jul. 6, 1994

[30] Foreign Application Priority Data

Jul. 9, 1993 [JP] Japan ..... 5-170461

[51] Int. Cl.[6] ..... B41J 2/21

[52] U.S. Cl. ..... 347/106; 347/43; 347/100

[58] Field of Search ..... 347/43, 100, 106

[56] References Cited

U.S. PATENT DOCUMENTS

| | | | |
|---|---|---|---|
| 4,385,901 | 5/1983 | Podder | 106/22 R |
| 4,689,078 | 8/1987 | Koike et al. | 347/106 X |
| 4,725,849 | 2/1988 | Koike et al. | 347/106 |
| 5,358,558 | 10/1994 | Yamamoto et al. | 106/22 R |
| 5,380,358 | 1/1995 | Aoki et al. | 106/20 R |

FOREIGN PATENT DOCUMENTS

| | | |
|---|---|---|
| 0553760 | 8/1993 | European Pat. Off. . |
| 0605730 | 7/1994 | European Pat. Off. . |
| 54-59936 | 5/1979 | Japan . |
| 61-118477 | 6/1986 | Japan . |
| 62-243890 | 10/1987 | Japan . |

*Primary Examiner*—Mark J. Reinhart

*Attorney, Agent, or Firm*—Fitzpatrick, Cella, Harper & Scinto

[57] ABSTRACT

Disclosed herein is a printing process in which at least three inks are applied to a cloth according to an ink-jet system to conduct printing, which comprises at least three steps of:

(a) applying at least two of the inks to the cloth in such a manner that at least parts of the two inks overlap each other;

(b) subjecting the cloth, to which the inks have been applied, to a heat treatment; and (c) washing the heat-treated cloth, wherein the cloth is a cloth comprising fibers dyeable with disperse dyes, each and of the inks comprises a specified coloring matter, a compound for dispersing the coloring matter and an aqueous liquid medium.

21 Claims, 3 Drawing Sheets

PRINTING PROCESS, AND PRINT AND PROCESSED ARTICLE OBTAINED THEREBY

BACKGROUND OF THE INVENTION

1. Field of the Invention

The present invention relates to a process for printing a cloth by ink-jet system, and a print and a processed article obtained thereby.

2. Related Background Art

At present, textile printing is principally conducted by screen printing or roller printing. Both methods are however unfit for multi-kind small-quantity production and difficult to quickly cope with the fashion of the day. Therefore, there has recently been a demand for establishment of an electronic printing system making no use of any plate.

In compliance with this demand, many textile printing processes according to an ink-jet recording have been proposed. Various fields expect much from such textile printing processes.

As conditions required for ink-jet textile printing, mention may be made of the following:

(1) being able to achieve sufficient color depth upon coloring of ink;

(2) being able to provide a print high in color yield of coloring matter on cloth and to conduct a waste water treatment after completion of washing with ease;

(3) causing little irregular bleeding due to color mixing between inks of different colors on cloth;

(4) being able to achieve color reproduction within a wide range; and (5) being able to always conduct stable production of prints.

In order to satisfy these requirements, it has heretofore been conducted principally to add various additives to ink, to control shot-in ink quantity, or to subject cloth to a pretreatment.

As an ink-jet printing method for cloth on which disperse dyes are used to conduct textile printing, for example, a polyester fabric, a method making use of disperse dyes having a sublimation temperature of 180° C. or higher is disclosed in Japanese Patent Application Laid-Open No. 61-118477. However, when textile printing is conducted with inks making use, as coloring matter, of the disperse dyes in which attention is paid to the sublimation temperature only, good coloring is achieved where the individual inks are used singly to dye, but the color depth and color tone after the dyeing, and color reproducibility upon dyeing under the same dyeing conditions greatly vary according to the combination of dyes used where the inks of different colors are mixed on the cloth, so that the above requirements (1), (4) and (5) are often not satisfied at the same time. Therefore, such a method has been yet insufficient to achieve various color expressions.

Accordingly, it has been impossible to fully satisfy the various requirements described above, in particular, the requirement (5) by the prior art only.

SUMMARY OF THE INVENTION

It is therefore an object of the present invention to provide an ink-jet printing process which can satisfy such requirements for the usual ink-jet printing as described above when conducting ink-jet printing on a cloth composed mainly of fibers dyeable with disperse dyes, can provide a print, in particular, high in color depth, bright and markedly wide in color reproduction range, and can stably form images even when the conditions of dyeing treatment by heating are somewhat changed, and to provide a print and a processed article obtained thereby.

Such an object can be achieved by the present invention described below.

According to the present invention, there is thus provided a printing process in which at least three inks of yellow, red and cyan colors are applied to a cloth according to an ink-jet system to conduct printing, which comprises at least three steps of:

(a) applying at least two of the inks to the cloth in such a manner that at least a part of the two inks overlap each other;

(b) subjecting the cloth, to which the inks have been applied, to a heat treatment; and (c) washing the heat-treated cloth, wherein the cloth is a cloth comprising fibers dyeable with disperse dyes, each of the inks comprises a coloring matter, a compound for dispersing the coloring matter and an aqueous liquid medium, the yellow ink comprises, as the coloring matter, at least one selected from the group consisting of C.I. Disperse Yellow 5, 42, 54, 64, 79, 83, 93, 99, 119, 122, 126, 160, 198, 204, 211, 224 and 237, the red ink comprises, as the coloring matter, at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33, and the cyan ink comprises, as the coloring matter, at least one selected from the group consisting of C.I. Disperse Blue 60, 87, 143, 176, 185, 198 and 354.

According to the present invention, there is also provided a print obtained by the printing process described above.

According to the present invention, there is further provided a processed article obtained by further processing the print described above.

According to the present invention, there is still further provided a print in which at least two coloring matters of yellow, red and cyan are dyed in a state that at least a part of the two coloring matters overlap each other, wherein the coloring matter of yellow comprises at least one selected from the group consisting of C.I. Disperse Yellow 5, 42, 54, 64, 79, 83, 93, 99, 119, 122, 126, 160, 198, 204, 211, 224 and 237, the coloring matter of red comprises at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33, the coloring matter of cyan comprises at least one selected from the group consisting of C.I. Disperse Blue 60, 87, 143, 176, 185, 198 and 354, and the print is obtained by printing a cloth comprising fibers dyeable with disperse dyes.

According to the present invention, there is still further provided a processed article obtained by further processing the print described above.

DESCRIPTION OF THE PREFERRED EMBODIMENTS

Figure 1:
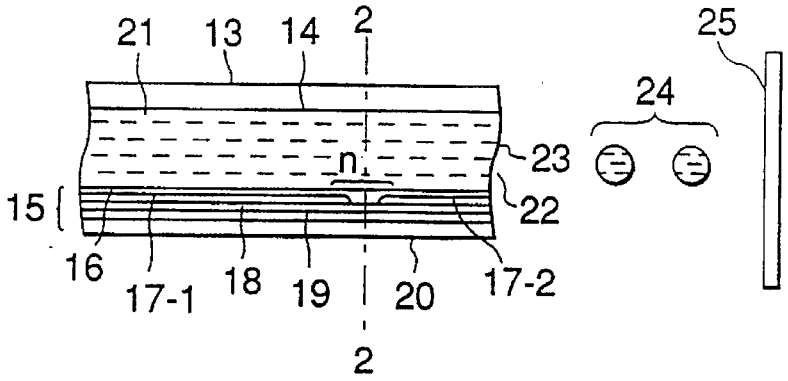
FIG. 1 is a longitudinal cross-sectional view of nozzle of a head of an ink-jet printing apparatus.

The cloth useful in the practice of the present invention will be first described.

A material making up the cloth used in the present invention comprises fibers dyeable with disperse dyes. Among others, those comprising polyester, acetate and/or triacetate are preferred. Of these, those comprising polyester are particularly preferred. The above-described fibers may be used in any form of woven fabric, knitting, nonwoven fabric and the like.

Such a cloth preferably comprises 100% of fibers dyeable with disperse dyes. However, blended yarn fabrics or nonwoven fabrics of the fibers dyeable with disperse dyes and other materials, for example, rayon, cotton, polyurethane, acrylic, nylon, wool and silk may be used as cloths for textile printing according to the present invention so far as the blending ratio of the fibers dyeable with the disperse dyes is at least 30%, preferably at least 50%.

The cloth for textile printing used in the present invention as described above may be subjected to any conventionally-known pretreatment as needed. In particular, it is preferable to treat the cloth with a solution containing urea, a water-soluble polymer, a water-soluble metal salt or the like contained in an amount of 0.01 to 20% by weight in the cloth.

Examples of the water-soluble polymer include known natural water-soluble polymers, for example, starches from corn, wheat and the like; cellulosics such as carboxymethyl cellulose, methyl cellulose and hydroxyethyl cellulose; polysaccharides such as sodium alginate, gum arabic, locust bean gum, tragacanth gum, guar gum and tamarind seed; proteins such as gelatin and casein; tannin and derivatives thereof; and lignin and derivatives thereof. Examples of synthetic water-soluble polymers include known polymers such as polyvinyl alcohol type compounds, polyethylene oxide type compounds, water-soluble acrylic polymers and water-soluble maleic anhydride polymers. Of these, the polysaccharide polymers and cellulosic polymers are preferred.

Examples of the water-soluble metal salt include compounds such as halides of alkali metals and alkaline earth metals, which form typical ionic crystals and an aqueous solution of which has a pH of 4 to 10. Representative examples of such compounds include NaCl, $Na_2SO_4$, KCl and $CH_3COONa$ for alkali metals, and $CaCl_2$ and $MgCl_2$ for alkaline earth metals. Of these, salts of Na, K and Ca are preferred.

The coloring matters, by which the present invention is principally characterized, and which are contained in the inks according to the present invention, will then be described.

Disperse dyes are used as such coloring matters. However, among coloring matters classified in these disperse dyes, the coloring matters used in the present invention are extremely limited from the viewpoint of hue, dyeing properties, ejection properties and the like.

The present inventors have prepared inks separately containing various kinds of disperse dyes and found that when these inks are mixed on the above-described cloth according to an ink-jet printing system, the color depth and color tone after the dyeing, and color reproducibility upon dyeing under the same dyeing conditions greatly vary according to the combination of dyes used compared with the conventional textile printing. This phenomenon has been particularly marked when using a dyeing treatment by a high-temperature (HT) steaming process or a thermosol process.

In the past, it has also been known that when polyester is intended to be dyed in one bath by "dip dyeing" or the like using two kinds of disperse dyes, the color depth may rarely vary according to the affinity between these dyes. This is said to be attributed to the structure that these dyes show in water (whether they are separated from or bonded to each other) ["Kaisetsu Senryo Kagaku (Exposition: Dyestuff Chemistry)", Shikisen-sha]. However, since this is a problem peculiar to "dip dyeing", this problem has been scarcely discussed in the conventional textile printing.

In textile printing by ink-jet printing, however, the variation depending upon the combination of dyes has become more noticeable than "dip dyeing".

This reason is not clear, but considered to be attributed to the fact that in a process such as the ink-jet printing in which ink droplets are successively applied to a cloth, the absolute amount of dyes applied is small and expression is made by dots, so that the variation depending upon the combination of dyes is manifested more clearly than the conventional dip dyeing.

The present inventors have carried out an extensive investigation in view of the above problem. As a result, it has been found that when very limited coloring matters, which will be described subsequently, are used, the color depth and color tone after dyeing do not vary even in any combination of such coloring matters, and color reproducibility after dyeing is also very stable.

From the above, the coloring matters usable in the present invention are limited to the following coloring matters.

As a coloring matter contained in the yellow ink, it is necessary to use at least one selected from the group consisting of C.I. Disperse Yellow 5, 42, 54, 64, 79, 83, 93, 99, 119, 122, 126, 160, 198, 204, 211, 224 and 237. In particular, it is more preferable to have at least one selected from the group consisting of C.I. Disperse Yellow 5, 42, 83, 93, 99, 198, 211 and 224 contained therein.

As a coloring matter contained in the red ink, it is necessary to use at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33. In particular, it is more preferable to have at least one selected from the group consisting of C.I. Disperse Red 86, 88, 92, 126, 135, 145, 152, 159, 177, 181, 206, 283 and 348 contained therein.

As a coloring matter contained in the cyan ink, it is necessary to use at least one selected from the group consisting of C.I. Disperse Blue 60, 87, 143, 176, 185, 198 and 354. In particular, it is more preferable to have at least one selected from the group consisting of C.I. Disperse Blue 60, 87, 143, 185, 198 and 354 contained therein.

Each of the inks according to the present invention contains at least one of its corresponding coloring matters. The total content of the coloring matters is within a range of from 1 to 25% by weight, preferably from 1.5 to 20% by weight, more preferably from 2 to 15% by weight based on the total weight of the ink.

The ink according to the present invention comprises at least the above-described coloring matter, a compound for dispersing such a coloring matter and an aqueous liquid medium.

As the compound for dispersing the coloring matter, may be used so-called dispersing agents, surfactants, resins and the like.

As the dispersing agents and surfactants, may be used both anionic and nonionic types. Examples of the anionic type include fatty acid salts, alkylsulfates, alkylbenzene sulfonates, alkylnaphthalene sulfonates, dialkylsulfosuccinates, salts of alkyl phosphates, naphthalenesulfonic acid-formalin condensates, polyoxyethylene alkylsulfates and substituted derivatives thereof. Examples of the nonionic type include polyoxyethylene alkyl ethers, polyoxyethylene alkyl phenyl ethers, polyoxyethylene fatty acid esters, sorbitan fatty acid esters, polyoxyethylene sorbitan fatty acid esters, polyoxyethylene alkylamines, glycerol fatty acid esters, oxyethylene-oxypropylene block copolymers and substituted derivatives thereof. Examples of the resinous dispersing agents include block copolymers, random copolymers and graft copolymers composed of at least two monomers (at least one of which is a hydrophilic monomer) selected from styrene and derivatives thereof, vinylnaphthalene and derivatives thereof, aliphatic alcohol esters and the like of α,β-ethylenically unsaturated carboxylic acids, acrylic acid and derivatives thereof, maleic acid and derivatives thereof, itaconic acid and derivatives thereof, fumaric acid and derivatives thereof, vinyl acetate, vinyl alcohol, vinylpyrrolidone, acrylamide, and derivatives thereof, and salts of these copolymers. These resins may preferably be alkali-soluble resins which are soluble in an aqueous solution of a base.

The inks according to the present invention further comprise an aqueous liquid medium, and water which is an essential component of the aqueous liquid medium is contained within a range of from 10 to 93% by weight, preferably from 25 to 87% by weight, more preferably from 30 to 82% by weight based on the total weight of the ink.

The aqueous liquid medium preferably comprises at least one organic solvent in combination with water. Examples of the organic solvent include ketones and keto-alcohols such as acetone and diacetone alcohol; ethers such as tetrahydrofuran and dioxane; addition polymers of oxyethylene or oxypropylene, such as diethylene glycol, triethylene glycol, tetraethylene glycol, dipropylene glycol, tripropylene glycol, polyethylene glycol, polypropylene glycol and the like; alkylene glycols the alkylene moiety of which has 2 to 6 carbon atoms, such as ethylene glycol, propylene glycol, trimethylene glycol, butylene glycol and hexylene glycol; thiodiglycol; glycerol and 1,2,6-hexanetriol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; 1,3-dimethyl-2-imidazolidinone; and the like.

The medium components as described above may be used either singly or in any combination thereof if used in combination with water. However, most preferable compositions of the liquid media are those comprising at least one polyhydric alcohol. Among others, a single solvent of thiodiglycol or diethylene glycol, or a mixed solvent system of diethylene glycol and thiodiglycol is particularly preferred.

The content of the water-soluble organic solvents as described above is generally within a range of from 5 to 60% by weight, preferably from 5 to 50% by weight based on the total weight of the ink.

The principal components of the inks according to the present invention are as described above. However, as other ingredients for the aqueous liquid medium, may be added various kinds of known viscosity modifiers, surface tension modifiers, optical whitening agents, antifoaming agents and the like as needed. Specific examples thereof include viscosity modifiers such as polyvinyl alcohol, cellulosics and water-soluble resins; surface tension modifiers such as diethanolamine and triethanolamine; pH adjustors according to buffer solutions; mildewproofing agents; and the like.

In addition, various kinds of surfactants and/or the like may be optionally added as an ingredient for the ink for purposes other than the dispersion of the dye.

The inks according to the present invention can be prepared from the coloring matters, the compounds for dispersing the coloring matters, the solvents, water and other additives using the conventionally-known dispersing method or mixing method.

In the printing process according to the present invention, droplets of the above-described inks are applied to the above-described cloth by an ink-jet system to form a color-mixing portion with at least two inks of different colors.

In this case, the total amount of individual coloring matters applied in the color-mixed portion is within a range of from 0.01 to 1 mg/cm$^2$, preferably from 0.015 to 0.6 mg/cm$^2$, more preferably from 0.02 to 0.4 mg/cm$^2$. This amount can be determined by actually measuring the amount of the inks ejected and the concentration of the coloring matters in the inks. If the amount of the coloring matters applied is less than 0.01 mg/cm$^2$, coloring at high color depth is difficult to achieve, so that the effects of the present invention are made unclear. If the amount of the coloring matters applied exceeds 1 mg/cm$^2$, effects of improving color depth, color reproduction range, dyeing stability and the like are not markedly recognized.

As the ink-jet system used for such ink-jet printing, may be used any conventionally-known ink-jet system. However, the method described in, for example, Japanese Patent Application Laid-Open No. 54-59936, in which thermal energy is applied to an ink so as to undergo rapid volume change, and the ink is ejected from a nozzle by action force caused by this change of state, i.e., a bubble jet system, is the most effective method.

The reason is believed to be that if a recording head equipped with a plurality of nozzles is used, the above system is narrow in scattering of ejection velocities of the ink among individual nozzles, and the ejection velocities are summarized within a range of from 5 to 20 m/sec, and so the degree of penetration of ink droplets into a cloth at the time the ink containing a disperse dye impacts the cloth at this velocity becomes optimum.

According to the present invention, neither deposition of foreign matter on a heating head nor disconnection occurs even if printing is conducted continuously for a long period of time by such a system. Therefore, the printing can be conducted stably.

As conditions under which a particularly high effect can be achieved by such an ink-jet system, it is preferred that an ejected ink droplet be within a range of from 20 to 200 pl, a shot-in ink quantity be within a range of from 4 to 40 nl/mm$^2$, a drive frequency be at least 1.5 kHz, and a head temperature be within a range of from 35° to 60° C.

The inks applied onto the cloth in the above-described manner only adhere to the cloth in this state. Accordingly, the cloth must be subsequently subjected to a dyeing treatment in which the coloring matter in each ink is fixed to the fibers, and a treatment for removing undyed coloring matter. Such dyeing and removal of the undyed coloring matter may be conducted in accordance with the conventionally known methods.

Among others, an HT steaming process or thermosol process may preferably be used as the dyeing method. In the case of the HT steaming process, the treatment may preferably be conducted under conditions of 140° to 180° C. and 2 to 30 minutes, more preferably under conditions of 160° to 180° C. and 6 to 8 minutes. In the case of the thermosol process, the treatment may preferably be conducted under conditions of 160° to 210° C. and 10 seconds to 5 minutes, more preferably under conditions of 180° to 210° C. and 20 seconds to 2 minutes.

Incidentally, the thus-obtained print can be cut into desired sizes as needed, and the cut pieces can then be subjected to processes required to obtain final processed articles, such as sewing, bonding and/or welding, thereby obtaining the processed articles such as k neckties or handkerchiefs.

As an illustrative example of an apparatus, which is suitable for use in conducting textile printing using the inks according to the present invention, may be mentioned an apparatus in which thermal energy corresponding to recording signals is applied to an ink within a recording head, and ink droplets are generated in accordance with the thermal energy. Such an apparatus will hereinafter be described.

Figure 2:
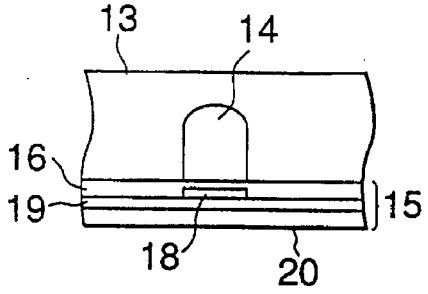
FIG. 2 is a transverse cross-sectional view of the nozzle of the head of the ink-jet printing apparatus.
Figure 3:
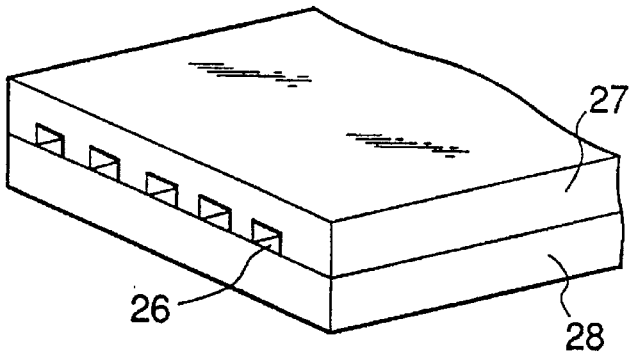
FIG. 3 is a perspective view of the appearance of a multi-nozzlehead which is an array of such nozzles as shown in FIG. 1.

Examples of the construction of a head, which is a main component of such an apparatus, are illustrated in FIGS. 1, 2 and 3.

A nozzle 13 of a head is formed by bonding a glass, ceramic, plastic plate or the like having a groove 14 through which ink is passed, to a heating plate 15 used in thermal recording (the drawing shows a head, to which the invention, however, is not limited). The heating plate 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property.

An ink 21 flows to an ejection orifice 22 (a minute opening) and forms a meniscus 23 owing to a pressure P.

Now, upon application of electric signals to the electrodes 17-1, 17-2, the heating plate 15 rapidly generates heat at the region shown by n to form bubbles in the ink 21 which is in contact with this region. The meniscus 23 of the ink is projected by the action of the pressure thus produced, and the ink 21 is ejected in the form of printing droplets 24 from the orifice 22 to a cloth 25 used in the present invention. FIG. 3 illustrates an appearance of a multi-nozzlehead composed of an array of a number of nozzle as shown in FIG. 1. The multi-head is formed by closely bonding a glass plate 27 having a number of grooves 26 to a heating plate 28 similar to the heating plate illustrated in FIG. 1. Incidentally, FIG. 1 is a cross-sectional view of a head taken along a flow path of the ink, and FIG. 2 is a cross-sectional view taken along line 2—2 of FIG. 1.

Figure 4:
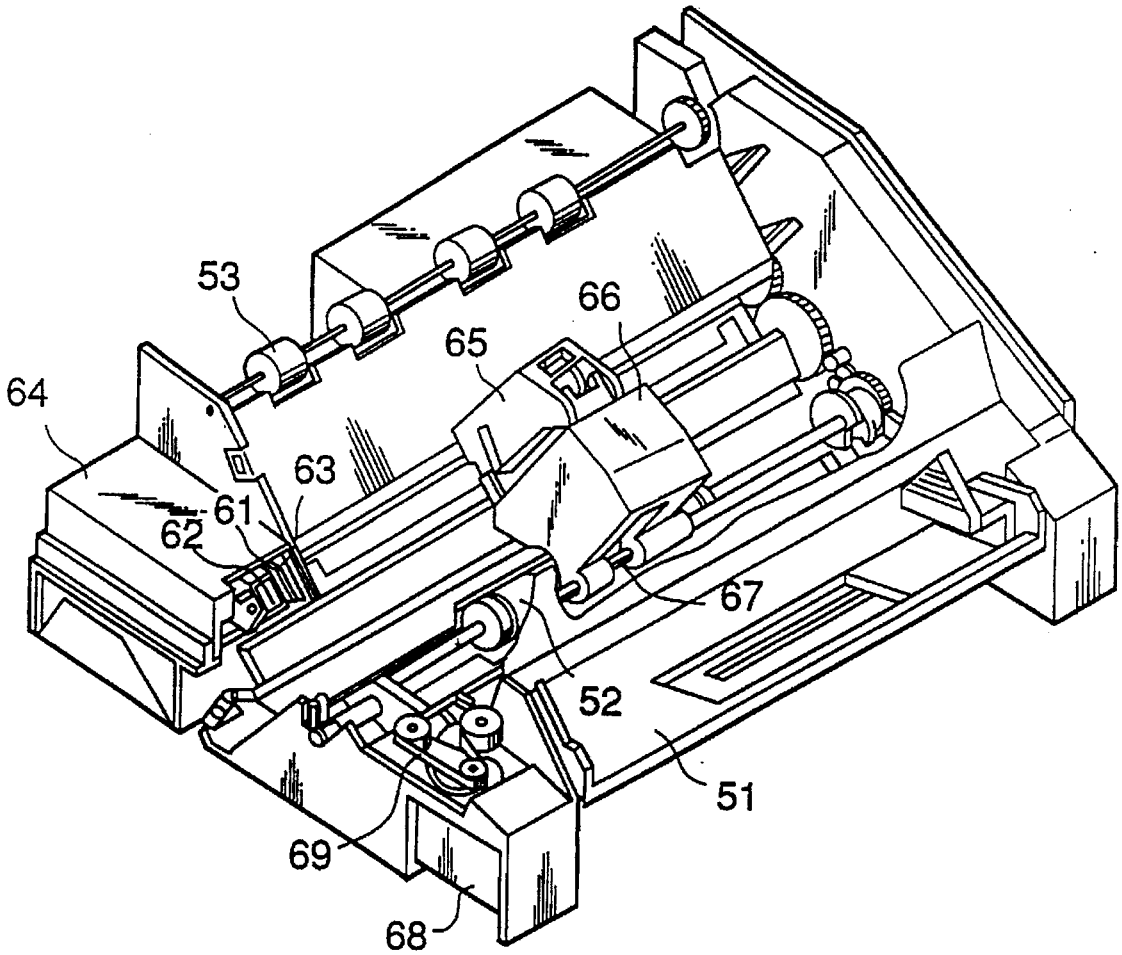
FIG. 4 is a perspective view of an illustrative ink-jet printing apparatus.

FIG. 4 illustrates an example of an ink-jet printing apparatus in which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes to the course through which the printing head is moved. Reference numeral 62 indicates a cap, which is provided at the home position adjacent to the blade 61, and is so constituted that it moves in the direction perpendicular to the direction in which the printing head is moved and comes into contact with the face of ejection openings to cap it. Reference numeral 63 denotes an absorbing member provided adjoiningly to the blade 61 and, similar to the blade 61, held in such a form that it protrudes to the course through which the printing head is moved. The above-described blade 61, cap 62 and absorbing member 63 constitute an ejection-recovery portion 64 for the printing head, where the blade 61 and absorbing member 63 remove off water, dust and/or the like from the face of the ink-ejecting openings. Reference numeral 65 designates the printing head having an ejection-energy-generating means and serving to eject the ink onto the cloth set in an opposing relation with the ejection opening face provided with ejection openings to conduct printing. Reference numeral 66 indicates a carriage on which the printing head 65 is mounted so that the printing head 65 can be moved. The carriage 66 is slidably interlocked with a guide rod 67 and is connected (not illustrated) to a belt 69 driven by a motor 68. Thus, the carriage 66 can be moved along the guide rod 67 and hence, the printing head 65 can be moved from a printing region to a region adjacent thereto.

Reference numerals 51 and 52 denote a cloth feeding part from which the cloths are separately inserted, and cloth feed rollers driven by a motor (not illustrated), respectively. With such construction, the cloth is fed to the position opposite to the ejection opening face of the printing head, and discharged from a cloth discharge section provided with cloth discharge rollers 53 with the progress of printing.

In the above constitution, the cap 62 in the head recovery portion 64 is receded from the moving course of the printing head 65 when the printing head 65 is returned to its home position, for example, after completion of printing, and the blade 61 remains protruded to the moving course. As a result, the ejection opening face of the printing head 65 is wiped. When the cap 62 comes into contact with the ejection opening face of the printing head 65 to cap it, the cap 62 is moved so as to protrude to the moving course of the printing head.

When the printing head 65 is moved from its home position to the position at which printing is started, the cap 62 and the blade 61 are at the same positions as the positions upon the wiping as described above. As a result, the ejection opening face of the printing head 65 is also wiped at the time of this movement.

The above movement of the printing head to its home position is made not only when the printing is completed or the printing head is recovered for ejection, but also when the printing head is moved between printing regions for the purpose of printing, during which it is moved to the home position adjacent to each printing region at given intervals, where the ejection opening face is wiped in accordance with this movement.

Figure 5:
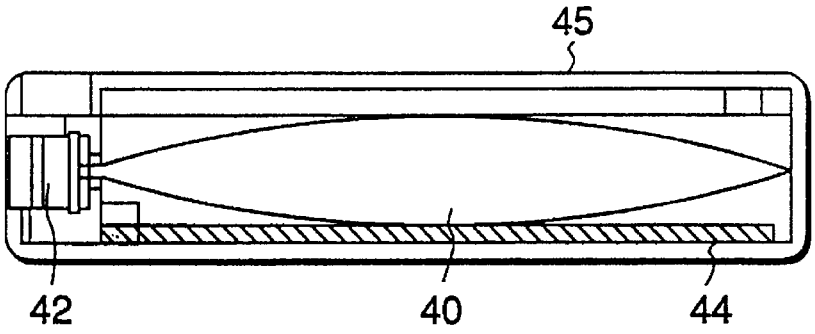
FIG. 5 is a longitudinal cross-sectional view of an ink cartridge.

FIG. 5 illustrates an exemplary ink cartridge in which an ink to be fed to the head through an ink-feeding member, for example, a tube is contained. Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink. In this invention, it is preferable that the ink container portion be formed of a polyolefin, in particular, polyethylene, at its surface with which the ink comes into contact. The ink-jet printing apparatus used in the present invention is not limited to the apparatus as described above in which the head and the ink cartridge are separately provided. Therefore, a device in which these members are integrally formed as shown in FIG. 6 can also be preferably used.

Figure 6:
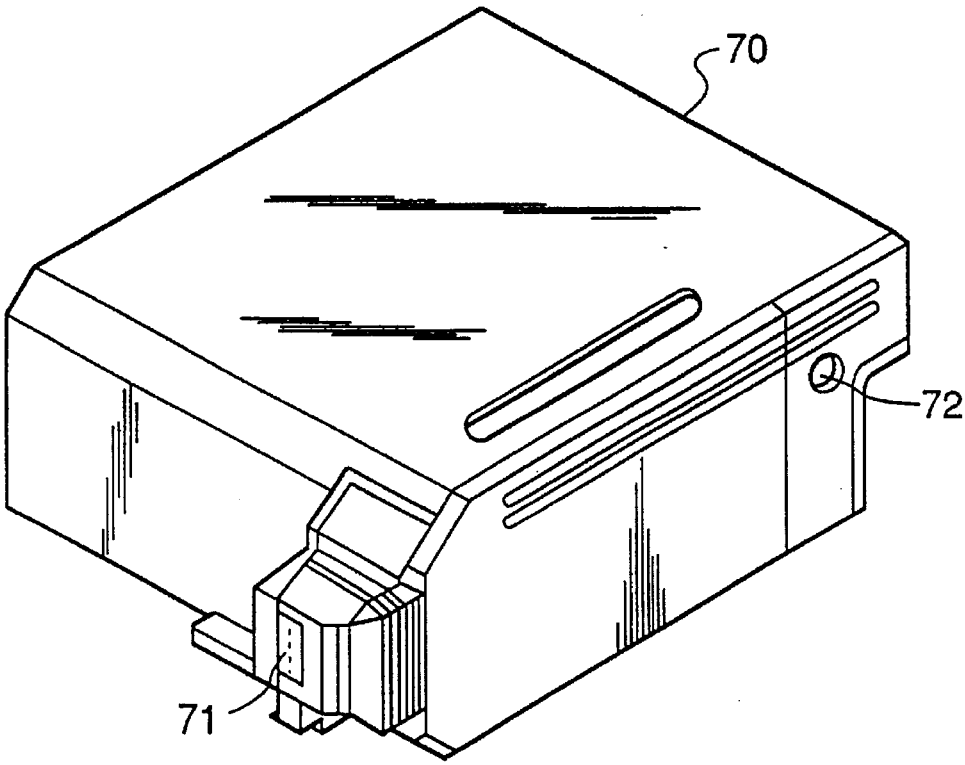
FIG. 6 is a perspective view of a printing unit.

In FIG. 6, reference numeral 70 designates a printing unit, in the interior of which an ink container portion containing an ink, for example, an ink-absorbing member, is contained. The printing unit 70 is so constructed that the ink in such an ink-absorbing member is ejected in the form of ink droplets through a head 71 having a plurality of orifices. In the present invention, polyurethane is preferably used as a material for the ink-absorbing member. Reference numeral 72 indicates an air passage for communicating the interior of the printing unit with the atmosphere. This printing unit 70 can be used in place of the printing head shown in FIG. 4, and is detachably installed on the carriage 66.

The present invention may be applied to office uses, but is particularly suitable for industrial uses other than the office uses.

The present invention will hereinafter be described more specifically by the following Examples and Comparative Examples. Incidentally, all designations of "part" or "parts" and "%" as will be used in the following examples mean part or parts by weight and % by weight unless expressly noted.

EXAMPLE 1

Preparation of Dye Dispersions I to III

| | |
|---|---|
| Sodium polyoxyethylene alkyl ether sulfate | 5 parts |
| Deionized water | 75 parts |
| Diethylene glycol | 5 parts |

The above components were mixed into a solution. To portions of this solution, were separately added 15 parts of the following disperse dyes to premix them for 30 minutes. Thereafter, the resulting premixes were subjected to a dispersion treatment under the following conditions:

Disperse dye:
C.I. Disperse Yellow 93 (for Dye Dispersion I)
C.I. Disperse Red 92 (for Dye Dispersion II)
C.I. Disperse Blue 87 (for Dye Dispersion III)

Dispersing machine:
Sand Grinder (manufactured by Igarashi Kikai K.K.)

Grinding medium:
zirconium beads (diameter: 1 mm)

Packing rate of the grinding medium:
50% (by volume)

Grinding time:
3 hours.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions I to III.

Preparation of Inks A to C

| | |
|---|---|
| Dye Dispersion I, II or III described above | 40 parts |
| Thiodiglycol | 24 parts |
| Diethylene glycol | 11 parts |
| Deionized water | 25 parts |

All the above respective components were mixed, and the resulting mixtures were adjusted to pH 5 to 7 with acetic acid, thereby preparing Inks A to C.

A 100% polyester woven fabric was immersed in a treatment solution (urea: 10%, sodium arginate: 2%, water 88%) in advance, squeezed to a pickup of 30% and then dried.

Inks A to C obtained in the above-described manner were charged in a Color Bubble Jet Printer BJC820 (trade name, manufactured by Canon Inc.) to print the following patterns each having a size of 2×4 cm on this woven fabric.

| Pattern | Ink used | Printing density of each ink | Printing density (total) |
|---|---|---|---|
| 1 | A, B | 50% | 100% |
| 2 | A, C | 50% | 100% |
| 3 | B, C | 50% | 100% |
| 4 | A, B | 100% | 200% |
| 5 | A, C | 100% | 200% |
| 6 | B, C | 100% | 200% |

(The printer used in this test ejects an ink in a shot-in ink quantity of 8.0 nl/mm$^2$ when printing in a printing density of 100%.)

The thus-obtained print samples were then fixed by a steaming treatment at 160° C. for 6 to 8 minutes. Thereafter, these samples were washed with a neutral detergent to evaluate them in coloring ability and color depth. As a result, as shown in Table 1, coloring stability in the color-mixed portions judged by the relative evaluation of K/S values was markedly good, and deep colors were produced even in the color-mixed portions having a printing density of 100%.

EXAMPLE 2

Preparation of Dye Dispersions IV to VI

| | |
|---|---|
| Sodium lignosulfonate | 2 parts |
| Deionized water | 73 parts |
| Diethylene glycol | 15 parts |

The above components were mixed into a solution. To portions of this solution, were separately added 10 parts of the following disperse dyes to premix them for 30 minutes. Thereafter, the resulting premixes were subjected to a dispersion treatment under the following conditions:

Disperse dye:
C.I. Disperse Yellow 224 (for Dye Dispersion IV)
C.I. Disperse Red 348 (for Dye Dispersion V)
C.I. Disperse Blue 198 (for Dye Dispersion VI)

Dispersing machine:
Sand Grinder (manufactured by Igarashi Kikai K.K.)

Grinding medium:
glass beads (diameter: 0.5 mm)

Packing rate of the grinding medium:
70% (by volume)

Grinding time:
3 hours.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions IV to VI.

Preparation of Inks D to F

| | |
|---|---|
| Dye Dispersion IV, V or VI described above | 30 parts |
| Thiodiglycol | 25 parts |
| Tetraethylene glycol dimethyl ether | 5 parts |
| Deionized water | 40 parts |

All the above respective components were mixed, and the resulting mixtures were adjusted to pH 5 to 7 with acetic acid, thereby preparing Inks D to F.

Using Inks D to F obtained in the above-described manner, the same patterns as those formed in Example 1 were printed on the same woven fabric as that used in Example 1 in the same manner as in Example 1. The thus-obtained print samples were then fixed by a thermosol treatment at 200° C for 40 to 50 seconds. Thereafter, these samples were washed with a neutral detergent to evaluate them in coloring ability and color depth. As a result, as shown in Table 1, coloring stability in the color-mixed portions judged by the relative evaluation of K/S values was markedly good, and deep colors were produced even in the color-mixed portions having a printing density of 100%.

EXAMPLE 3

Preparation of Dye Dispersions VII to IX

| | |
|---|---|
| β-Naphthalenesulfonic acid-formaldehyde condensate | 20 parts |
| Deionized water | 50 parts |
| Diethylene glycol | 10 parts |

The above components were mixed into a solution. To portions of this solution, were separately added 20 parts of the following disperse dyes to premix them for 30 minutes. Thereafter, the resulting premixes were subjected to a dispersion treatment under the following conditions:

Disperse dye:
C.I. Disperse Yellow 99 (for Dye Dispersion VII)
C.I. Disperse Red 283 (for Dye Dispersion VIII)
C.I. Disperse Blue 185 (for Dye Dispersion IX)

Dispersing machine:
Pearl Mill (manufactured by Ashizawa K.K.)

Grinding medium:
glass beads (diameter: 1 mm)

Packing rate of the grinding medium:
50% (by volume)

Discharging rate:
100 ml/min.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions VII to IX.

Preparation of Inks G to I

| | |
|---|---|
| Dye Dispersion VII, VIII or IX described above | 50 parts |
| Thiodiglycol | 23 parts |
| Diethylene glycol | 5 parts |
| Isopropyl alcohol | 3 parts |
| Deionized water | 19 parts |

All the above respective components were mixed, and the resulting mixtures were adjusted to pH 5 to 7 with acetic acid, thereby preparing Inks G to I.

A blended yarn fabric formed of 70% of polyester and 30% of cotton was immersed in a treatment solution (urea: 10%, carboxymethyl cellulose: 2%, water 88%) in advance, squeezed to a pickup of 30% and then dried. Using Inks G to I obtained in the above-described manner, the same patterns as those formed in Example 1 were printed on this woven fabric in the same manner as in Example 1. The thus-obtained print samples were then fixed by a steaming treatment at 160° C. for 6 to 8 minutes. Thereafter, these samples were washed with a neutral detergent to evaluate them in coloring ability and color depth. As a result, as shown in Table 1, coloring stability in the color-mixed portions judged by the relative evaluation of K/S values was markedly good, and deep colors were produced even in the color-mixed portions having a printing density of 100%.

Comparative Example 1

Preparation of Dye Dispersions X to XII

| | |
|---|---|
| Sodium polyoxyethylene alkyl ether sulfate | 5 parts |
| Deionized water | 75 parts |
| Diethylene glycol | 5 parts |

The above components were mixed into a solution. To portions of this solution, were separately added 15 parts of the following disperse dyes to premix them for 30 minutes. Thereafter, the resulting premixes were subjected to a dispersion treatment under the following conditions:

Disperse dye:
C.I. Disperse Yellow 56 (for Dye Dispersion X)
C.I. Disperse Red 43 (for Dye Dispersion XI) C.I. Disperse Blue 7 (for Dye Dispersion XII)

Dispersing machine:
Sand Grinder (manufactured by Igarashi Kikai K.K.)

Grinding medium:
zirconium beads (diameter: 1 mm)

Packing rate of the grinding medium:
50% (by volume)

Grinding time:
3 hours.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions X to XII.

Preparation of Inks J to L

| | |
|---|---|
| Dye Dispersion X, XI or XII described above | 40 parts |
| Thiodiglycol | 24 parts |
| Diethylene glycol | 11 parts |
| Deionized water | 25 parts |

All the above respective components were mixed, and the resulting mixtures were adjusted to pH 5 to 7 with acetic acid, thereby preparing Inks J to L.

Using Inks J to L obtained in the above-described manner, the same patterns as those formed in Example 1 were printed on the same woven fabric as that used in Example 1 in the same manner as in Example 1. The thus-obtained print samples were then fixed by a steaming treatment at 160° C. for 6 to 8 minutes. Thereafter, these samples were washed with a neutral detergent to evaluate them in coloring ability and color depth. As a result, as shown in Table 1, coloring stability in the color-mixed portions judged by the relative evaluation of K/S values was poor compared with Example 1, and no deep colors were produced in the color-mixed portions having a printing density of 100%.

Comparative Example 2

Preparation of Dye Dispersion XIII

| | |
|---|---|
| Sodium polyoxyethylene alkyl ether sulfate | 5 parts |
| Deionized water | 75 parts |
| Diethylene glycol | 5 parts |

The above components were mixed into a solution. To this solution, were added 15 parts of the following disperse dye to premix them for 30 minutes. Thereafter, the resulting premix was subjected to a dispersion treatment under the following conditions:

Disperse dye:
C.I. Disperse Yellow 163 (for Dye Dispersion XIII)
Dispersing machine:
Sand Grinder (manufactured by Igarashi Kikai K.K.)
Grinding medium:
zirconium beads (diameter: 1 mm)
Packing rate of the grinding medium:
50% (by volume)
Grinding time:
3 hours.

The dispersion was further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersion XIII.

Preparation of Ink M

| | |
|---|---|
| Dye Dispersion XIII described above | 40 parts |
| Thiodiglycol | 24 parts |
| Diethylene glycol | 11 parts |
| Deionized water | 25 parts |

All the above components were mixed, and the resulting mixture was adjusted to pH 5 to 7 with acetic acid, thereby preparing Ink M.

Using Ink M obtained in the above-described manner and Inks B and C used in Example 1, the same patterns as those formed in Example 1 were printed on the same woven fabric as that used in Example 1 in the same manner as in Example 1. The thus-obtained print samples were then fixed by a steaming treatment at 160° C. for 6 to 8 minutes. Thereafter, these samples were washed with a neutral detergent to evaluate them in coloring ability and color depth. As a result, as shown in Table 1, coloring stability in the color-mixed portions judged by the relative evaluation of K/S values was poor compared with Example 1, and there were some cases where no deep colors were produced in the color-mixed portions having a printing density of 100%.

Comparative Example 3

Preparation of Dye Dispersion XIV and XV

| | |
|---|---|
| β-Naphthalenesulfonic acid-formaldehyde condensate condensate | 20 parts |
| Deionized water | 50 parts |
| Diethylene glycol | 10 parts |

The above components were mixed into a solution. To portions of this solution, were separately added 20 parts of the following disperse dyes to premix them for 30 minutes. Thereafter, the resulting premixes were subjected to a dispersion treatment under the following conditions:

Disperse dye:
C.I. Disperse Yellow 56 (for Dye Dispersion XIV)
C.I. Disperse Red 227 (for Dye Dispersion XV)
Dispersing machine:
Pearl Mill (manufactured by Ashizawa K.K.)
Grinding medium:
glass beads (diameter: 1 mm)
Packing rate of the grinding medium:
50% (by volume)
Discharging rate:
100 ml/min.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions XIV and XV.

Preparation of Inks N and O

| | |
|---|---|
| Dye Dispersion XIV or XV described above | 50 parts |
| Thiodiglycol | 23 parts |
| Diethylene glycol | 5 parts |
| Isopropyl alcohol | 3 parts |
| Deionized water | 19 parts |

All the above respective components were mixed, and the resulting mixtures were adjusted to pH 5 to 7 with acetic acid, thereby preparing Inks N and O.

Using Inks N and O obtained in the above-described manner and Ink I used in Example 3, the same patterns as those formed in Example 1 were printed on the same woven fabric as that used in Example 3 in the same manner as in Example 1. The thus-obtained print samples were then fixed by a steaming treatment at 160° C. for 6 to 8 minutes. Thereafter, these samples were washed with a neutral detergent to evaluate them in coloring ability and color depth. As a result, as shown in Table 1, coloring stability in the color-mixed portions judged by the relative evaluation of K/S values was poor compared with Example 3, and no deep colors were produced in the color-mixed portions having a printing density of 100%.

TABLE 1

| | Coloring stability*1 | Depth of color in portion*2 of 100% printing density |
|---|---|---|
| Ex. 1 | A | A |
| Ex. 2 | A | A |
| Ex. 3 | A | A |

TABLE 1-continued

| | Coloring stability*1 | Depth of color in portion*2 of 100% printing density |
|---|---|---|
| Comp. Ex. 1 | C | C |
| Comp. Ex. 2 | B | B |
| Comp. Ex. 3 | C | C |

*1: K/S values of the print samples subjected to the steaming treatment for 6 minutes and 8 minutes, respectively, as to Examples 1 and 3 and Comparative Examples 1 to 3, and K/S values of the print samples subjected to the thermosol treatment for 40 second and 50 seconds, respectively, as to Example 2 were measured to evaluate the coloring stability in terms of the remainder of the K/S values in the steaming treatment for 6 minutes and 8 minutes or in the thermosol treatment for 40 seconds and 50 seconds in accordance with the following standard:
A: The remainder of K/S values was smaller than 1, which meant that the coloring stability does not vary vary much depending upon the heating conditions;
B: The remainder of K/S values was 1 to 2, which meant that the coloring stability somewhat varies depending upon the heating conditions;
C: The remainder of K/S values was greater than 2, which meant that the coloring stability considerably varies depending upon the heating conditions.
$K/S = (1 - R)^2/2 \times R$ (R: reflectance at a maximum absorption wavelength).
*2: K/S values of two color-mixed portions (all of three combinations of 3 colors) having printing densities of 100% and 200%, respectively, after coloring were measured to judge the color depth of the 100-% portions by the relative evaluation between the 100-% portions and the 200-% portions in accordance with the following standard:
A: The K/S values of the 200-% portions were smaller than 1.5 times of the K/S values of the 100-% portions in all the three combinations (deep colors were produced in all the 100-% portions);
B: The K/S values of the 200-% portions were smaller than 1.5 times of the K/S values of the 100-% portions in at least one combination (deep colors were produced in parts of the 100-% portions);
C: The K/S values of the 200-% portions were not smaller than 1.5 times of the K/S values of the 100-% portions in all the three combinations (no deep colors were produced in all the 100-% portions);

According to the present invention, as described above, prints deep in color depth, bright, wide in color reproduction range and excellent in production stability can be obtained upon mixing two of the yellow, red and cyan inks on the cloth.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. A printing process in which at least three inks of yellow, red and cyan colors are applied to a cloth according to an ink-jet system to conduct printing, which comprises the steps of:

(a) applying at least two of the inks to the cloth wherein at least parts of the inks overlap each other in a color mixed portion;

(b) subjecting the cloth, to which the inks have been applied, to a heat treatment; and (c) washing the heat-treated cloth, wherein the cloth is a cloth comprising fibers dyeable with disperse dyes, each of the inks comprises a coloring matter, a compound for dispersing the coloring matter and an aqueous liquid medium, the yellow ink comprises, as the coloring matter, at least one selected from the group consisting of C.I. Disperse Yellow 5, 42, 54, 64, 79, 83, 93, 99, 119, 122, 126, 160, 198, 204, 211, 224 and 237, the red ink comprises, as the coloring matter, at least one selected from the group consisting of C.I. Disperse Red 86, 88, 92, 126, 135, 145, 152, 159, 177, 181, 206, 283 and 348, and the cyan ink comprises, as the coloring matter, at least one selected from the group consisting of C.I. Disperse Blue 60, 87, 143, 176, 185, 198 and 354, and a total amount of each coloring matter applied in the color mixed portion is in a range of from 0.01 to 1 mg/cm$^2$.

2. The printing process according to claim 1, wherein the cloth comprises polyester fibers.

3. The printing process according to claim 1, wherein the heat treatment comprises a high-temperature steaming process or a thermosol process.

4. The printing process according to claim 1, wherein the ink-jet system comprises a system in which the inks are ejected using thermal energy.

5. The printing process according to claim 1 or 4, wherein an ejection velocity of the inks is 5 to 20 m/sec.

6. The printing process according to claim 1, which comprises a step of pretreating the cloth prior to the applying step (a).

7. A printed cloth, obtainable by a printing process wherein the cloth is dyed by applying at least two coloring matters from among yellow, red and cyan such that at least a part of the coloring matters overlap each other in a color mixed portion, and wherein the coloring matter of yellow comprises at least one selected from the group consisting of C.I. Disperse Yellow 5, 42, 54, 64, 79, 83, 93, 99, 119, 122, 126, 160, 198, 204, 211, 224 and 237, the coloring matter of red comprises at least one selected from the group consisting of C.I. Disperse Red 86, 88, 92, 126, 135, 145, 152, 159, 177, 181, 206, 283 and 348, the coloring matter of cyan comprises at least one selected from the group consisting of C.I. Disperse Blue 60, 87, 143, 176, 185, 198 and 354, and a total amount of each coloring matter applied in the color portion is in a range of from 0.01 to 1 mg/cm$^2$.

8. The printed cloth according to claim 7, wherein the cloth comprises polyester fibers.

9. The printing process according to claim 1, wherein the coloring matter of yellow color is selected from the group consisting of C.I. Disperse Yellow 5, 42, 83, 93, 99, 198, 211 and 224.

10. The printing process according to claim 1, wherein the coloring matter of cyan color is selected from the group consisting of C.I. Disperse Blue 60, 87, 143, 185, 198 and 354.

11. The printing process according to claim 1, wherein the total amount of each coloring matter applied in the color mixed portion is in a range of from 0.015 to 0.6 mg/cm$^2$.

12. The printing process according to claim 1, wherein the total amount of each coloring matter applied in the color mixed portion is in the range of from 0.02 to 0.4 mg/cm$^2$.

13. The printing process according to claim 1, further comprising a step of treating the cloth with a solution containing at least one material selected from the group consisting of urea, a water-soluble polymer, and a water-soluble metal salt, prior to said applying step (a).

14. The printing process according to claim 13, wherein the water-soluble polymer is a material selected from the group consisting of starch, carboxymethyl cellulose, methyl cellulose, hydroxyethyl cellulose, sodium alginate, gum arabic, locust bean gum, tragacanth gum, guar gum, tamarind seed, gelatin, casein, polyvinyl alcohol, polyethylene oxide, water-soluble acrylic polymers and water-soluble maleic anhydride polymers.

15. The printing process according to claim 13, wherein the water-soluble metal salt comprises sodium chloride, sodium sulfate, potassium chloride, sodium acetate, calcium chloride, or magnesium chloride.

16. The printing process according to claim 13, wherein the material contained in the solution is contained in an amount of 0.01 to 20% by weight in the cloth.

17. The printed cloth according to claim 7, wherein the yellow coloring matter is selected from the group consisting of C.I. Disperse Yellow 5, 42, 83, 93, 99, 198, 211 and 224.

18. The printed cloth according to claim 7, wherein the cyan coloring matter is selected from the group consisting of C.I. Disperse Blue 60, 87, 143, 185, 198 and 354.

19. The printed cloth according to claim 7, wherein the total amount of each coloring matter applied in the color mixed portion is in a range of from 0.015 to 0.6 $mg/cm^2$.

20. The printed cloth according to claim 7, wherein the total amount of each coloring matter applied in the color mixed portion is in a range of from 0.02 to 0.4 $mg/cm^2$.

21. An article obtained by cutting into pieces the printed cloth of any one of claims 7, 8 and 17 to 20, and at least one of sewing, bonding and welding the pieces.

* * * * *

UNITED STATES PATENT AND TRADEMARK OFFICE

CERTIFICATE OF CORRECTION

PATENT NO. : 5,635,970 Page 1 of 2

DATED : June 3, 1997

INVENTOR(S) : Koromo SHIROTA, et al.

It is certified that error appears in the above-indentified patent and that said Letters Patent is hereby corrected as shown below:

ON THE COVER PAGE:

AT [57] Abstract:

Line 11, "each and" should read --and each--.

COLUMN 2:

Line 61, "of nozzle" should read --of a nozzle--;
Line 66, "multi-nozzlehead" should read --multi-nozzle head--.

COLUMN 7:

Line 23, "as k" should read --as--;
Line 54, "multi-nozzlehead" should read --multi-nozzle head--;
Line 55, "nozzle" should read --nozzles--;
Line 56, "multi-head" should read --multi-nozzle head--.

UNITED STATES PATENT AND TRADEMARK OFFICE

CERTIFICATE OF CORRECTION

PATENT NO. : 5,635,970 Page 2 of 2

DATED : June 3, 1997

INVENTOR(S) : Koromo SHIROTA, et al.

It is certified that error appears in the above-indentified patent and that said Letters Patent is hereby corrected as shown below:

COLUMN 15:

Line 19, "vary vary" should read --vary--.

Signed and Sealed this

Twenty-third Day of December, 1997

Bruce Lehman

*Attest:*

BRUCE LEHMAN

*Attesting Officer*

*Commissioner of Patents and Trademarks*